US006623199B2

(12) United States Patent
Naramoto et al.

(10) Patent No.: US 6,623,199 B2
(45) Date of Patent: Sep. 23, 2003

(54) THRUST-OUT TYPE CONTAINER FOR A ROD-LIKE ARTICLE

(75) Inventors: Satoru Naramoto, Chiba-ken (JP); Hiroshi Yamazaki, Chiba-ken (JP); Yutaka Mihara, Chiba-ken (JP)

(73) Assignee: Hidan Co., Ltd, Chiba-Ken (JP)

( * ) Notice: Subject to any disclaimer, the term of this patent is extended or adjusted under 35 U.S.C. 154(b) by 0 days.

(21) Appl. No.: 10/237,599

(22) Filed: Sep. 10, 2002

(65) Prior Publication Data

US 2003/0053842 A1 Mar. 20, 2003

(30) Foreign Application Priority Data

Sep. 18, 2001 (JP) ..... 2001-283883

(51) Int. Cl.[7] ..... B43K 23/00
(52) U.S. Cl. ..... 401/98; 401/75
(58) Field of Search ..... 401/75, 55, 68, 401/88, 82, 98

(56) References Cited

U.S. PATENT DOCUMENTS 4,603,989 A * 8/1986 Ackerman et al. ..... 401/98
5,863,144 A * 1/1999 Ackermann ..... 401/98
6,116,802 A * 9/2000 Gueret ..... 401/98
6,224,281 B1 * 5/2001 Kim ..... 401/75

FOREIGN PATENT DOCUMENTS

JP 2000-300337 10/2000

* cited by examiner

*Primary Examiner*—David J. Walczak
(74) *Attorney, Agent, or Firm*—Clark & Brody

(57) ABSTRACT

A thrust-out type container for a rod-like article such as a lipstick basically comprising a body and a cap. The body has an axis C extending in a vertical direction and comprises, around the axis C and radially outward from the axis C, a movable member, an inner cylindrical tube, an outer cylindrical tube and a control tube in this order. An intermediate cylindrical tube is interposed between the outer cylindrical tube and the control tube. The intermediate cylindrical tube is fixed to the control tube and rotatable around the outer cylindrical tube. An outer peripheral surface of the intermediate cylindrical tube and an inner peripheral surface of the cap come in air-tight contact with each other. The intermediate cylindrical tube extends downward beyond respective lower ends of the inner and outer cylindrical tubes and has a bottom covering the respective lower ends of these tubes.

6 Claims, 5 Drawing Sheets

PRIOR ART

THRUST-OUT TYPE CONTAINER FOR A ROD-LIKE ARTICLE

BACKGROUND OF THE INVENTION

This invention relates to a thrust-out type container for a rod-like article such as a lipstick.

FIG. 5 is a cross-sectional view showing a thrust-out type container for a rod-like article disclosed in Japanese Patent Publication No. 2000-300337A. This container 101 comprises an inner cylindrical tube 103 housing a lipstick L so that the lipstick L can move in a vertical direction and a lower covering tube 108 which is integral with a lower outer cylindrical tube 106 formed with a spiral groove 166. An upper covering tube 109 is interposed between the inner cylindrical tube 103 and the lower covering tube 108. The upper covering tube 109 is slidably in close contact with an outer peripheral surface of the inner cylindrical tube 103 and fixed to an inner peripheral surface of the lower covering tube 108. An O-ring 194 is interposed between the lower covering tube 108 and the upper covering tube 109. Except when the lipstick L is actually used, a cap (not shown) is put on this container 101.

With the container of the well known art as has been described above, the entire container can be maintained substantially air-tight state by putting the cap on the lower covering tube having its bottom closed. Theoretically, evaporation of low boiling point ingredients contained in the lipstick can be restrained and thereby a storage stability of the lipstick can be improved. However, in the course of press working or alumite working the lower and upper covering tubes and/or in the course of compressing the upper covering tube into the lower covering tube in the assembling process for the container, the inner surface of the lower covering tube and/or the outer surface of the upper covering tube may be formed with scratches extending in the vertical direction. Evaporation of ingredients contained in the lipstick through such scratches may deteriorate the storage stability of the lipstick. While the O-ring interposed between the lower covering tube and the upper covering tube certainly offers a packing effect between these tubes, it is impossible for the O-ring to block the grooves formed by the scratches. With the lower covering tube presenting a polygonal cross-section in a radial direction, it will be difficult to maintain the upper covering tube in close contact with the inner surface of the lower covering tube at every corner of the polygonal cross-section and thereby to maintain the interior of the lower covering tube in air-tight condition. In this case also, the storage stability of the lipstick is apt to be deteriorated.

SUMMARY OF THE INVENTION

This invention relates to an improvement in the container of the well known art as has been described above and aims to improve a preventive effect of the container against evaporation of the low boiling point ingredients contained in the rod-like article such as a lipstick confined therein.

According to this invention, by an improvement in a thrust-out type container for a rod-like article having a vertical direction and a radial direction orthogonal to the vertical direction and basically comprising a body adapted to thrust out the rod-like article through an opening formed at its upper end in the vertical direction and a cap adapted to be detachably put on the body from above in the vertical direction, the body comprising, around an axis extending in the vertical direction and radially outward from this axis, a movable member, an inner cylindrical tube, an outer cylindrical tube and a control tube in this order, the movable member being adapted to carry the rod-like article thereon and movable in the vertical direction, the inner cylindrical tube having an opening at its upper end in the vertical direction and lying outside the movable member to receive the movable member so that the movable member can move in the vertical direction and rotate together with the inner cylindrical tube around the axis, the outer cylindrical tube having an opening at its upper end in the vertical direction and lying outside the inner cylindrical tube to receive the inner cylindrical tube so that the inner cylindrical tube can rotate around the axis, the control tube lying outside the outer cylindrical tube and coupled to the inner cylindrical tube below the outer cylindrical tube so that the control tube can rotate around the axis together with the inner cylindrical tube, the body further comprising, between the outer cylindrical tube and the control tube, an intermediate cylindrical tube fixed to a peripheral surface of the control tube, surrounding the outer cylindrical tube and being rotatable around the outer cylindrical tube wherein an outer peripheral surface of the intermediate cylindrical tube and an inner peripheral surface of the cap come in air-tight contact with each other.

This invention further comprises the intermediate cylindrical tube extending downward beyond respective lower ends of the inner and outer cylindrical tubes and having a closed bottom covering the respective lower ends of these inner and outer cylindrical tubes from below.

This invention includes preferred embodiments as follow:

(1) The movable member presents a circular or polygonal cross-section in the radial direction and includes at least one arm extending outward from an outer peripheral surface of the movable member in the radial direction of the movable member, and the inner cylindrical tube has a first upper end as viewed in the vertical direction, a first lower end as viewed in the vertical direction and a first peripheral wall extending between these two ends, the first peripheral wall being formed with at least one guide slit by making a long cut therein in the vertical direction so that the arm of the movable member lying inside the first peripheral wall extends outward and can be guided through the slit in the vertical direction.

(2) The outer cylindrical tube has a second upper end as viewed in the vertical direction, a second lower end as viewed in the vertical direction and a second peripheral wall extending between these two ends, the second peripheral wall being formed on its inner surface with at least one spiral groove extending between these two ends so as to receive the arm of the movable member slidably along the spiral groove.

(3) The intermediate cylindrical tube is coupled to the inner cylindrical tube below the outer cylindrical tube so that the intermediate cylindrical tube can rotate together with the inner cylindrical tube.

(4) A second intermediate cylindrical tube presenting a polygonal cross-section in the radial direction is interposed between the control tube and the intermediate cylindrical tube.

(5) The control tube presents a polygonal cross-section in the radial direction.

DETAILED DESCRIPTION OF THE PREFERRED EMBODIMENTS

Details of the thrust-out type container for a rod-like article according to this invention will be more fully understood from the description of a lipstick container as one of the typical embodiments given hereunder in reference with the accompanying drawings.

Figure 1:
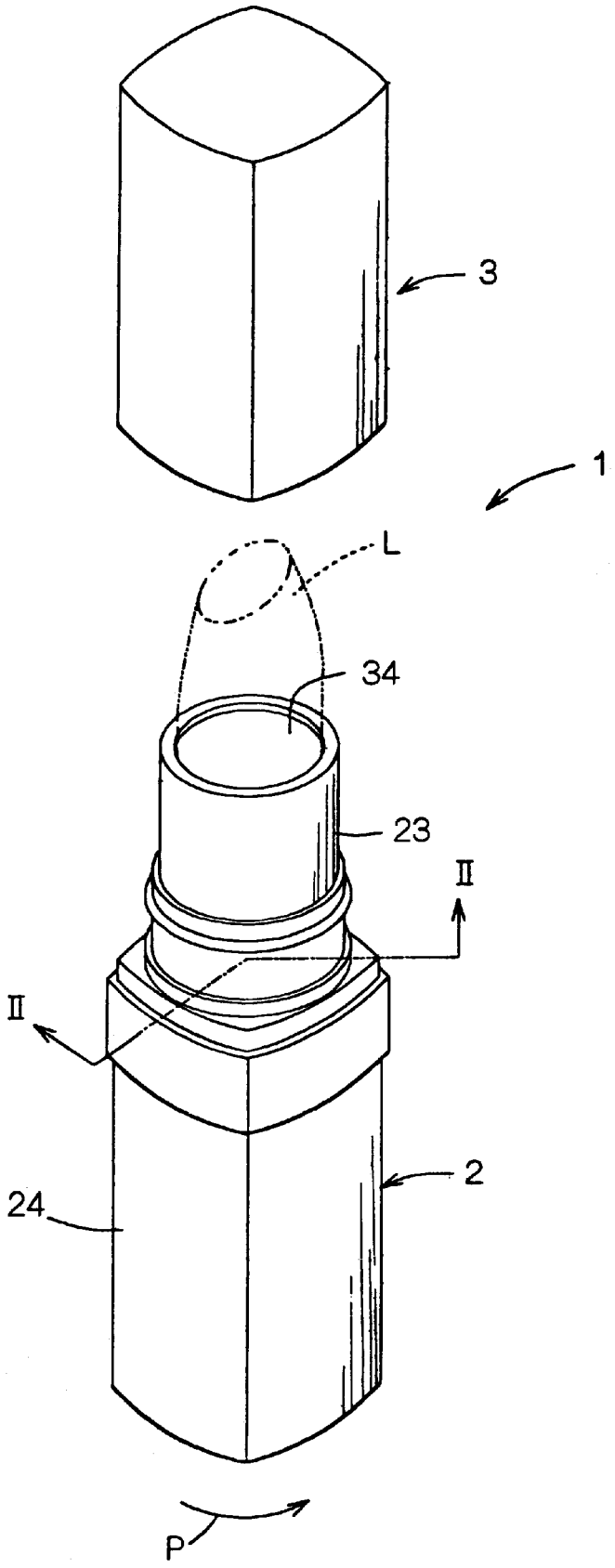
FIG. 1 is a perspective view of a thrust-out type container according to this invention.

FIG. 1 is a perspective view of a lipstick container 1. The container 1 is generally shaped in square tube extending in a vertical direction and comprises a body 2 and a cap 3 detachably placed on a top of the body 2. This cap 3 is illustrated as has been detached. The body 2 is arranged so that a control tube 24 may be rotated in a direction indicated by an arrow P with an outer cylindrical tube 23 held with fingers to thrust a lipstick L out from a top opening 34 of the outer cylindrical tube 23 as indicated by imaginary lines and rotated in a direction opposite to the direction of the arrow P to retract the lipstick L.

Figure 2:
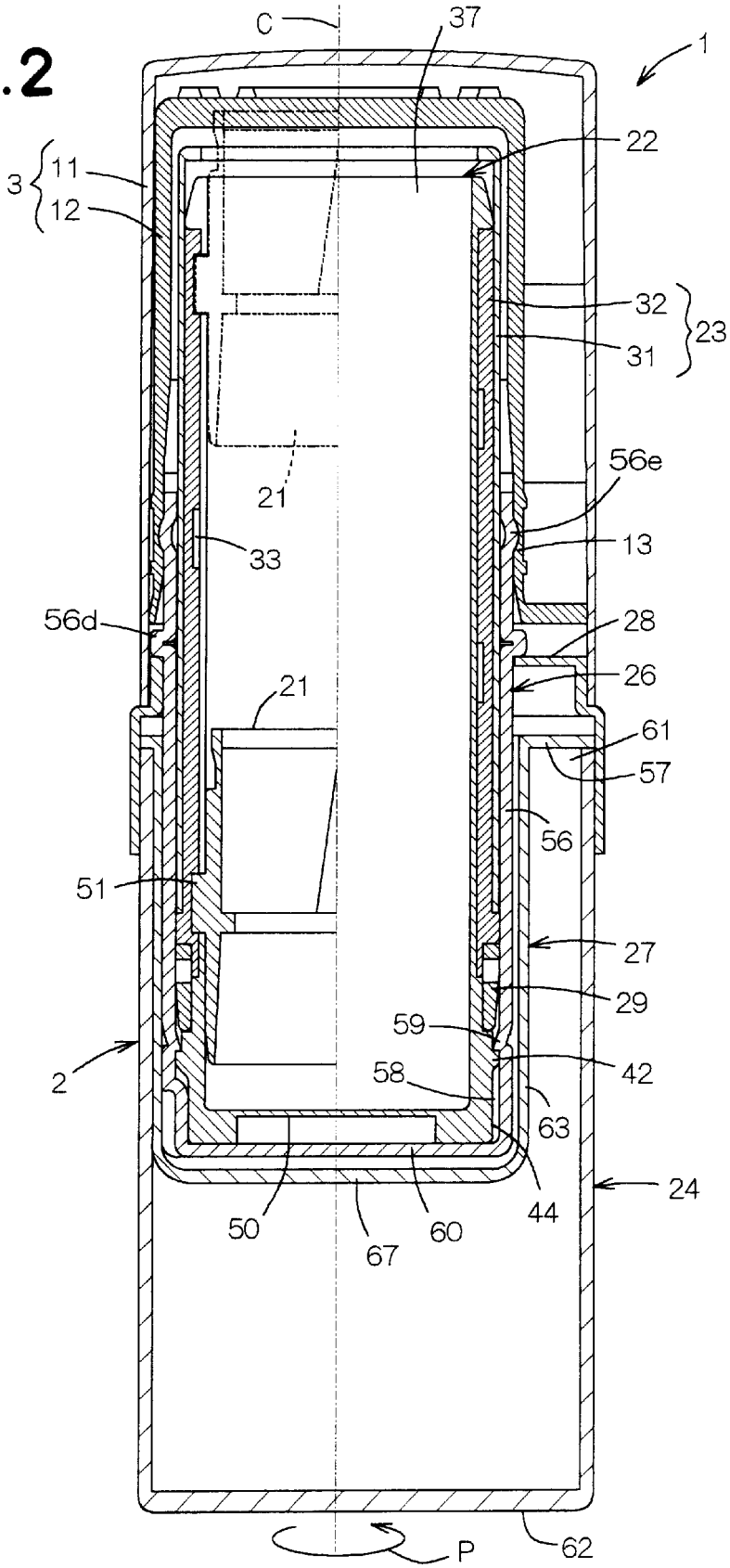
FIG. 2 is a cross-sectional view taken along a line II—II in FIG. 1.
Figure 3:
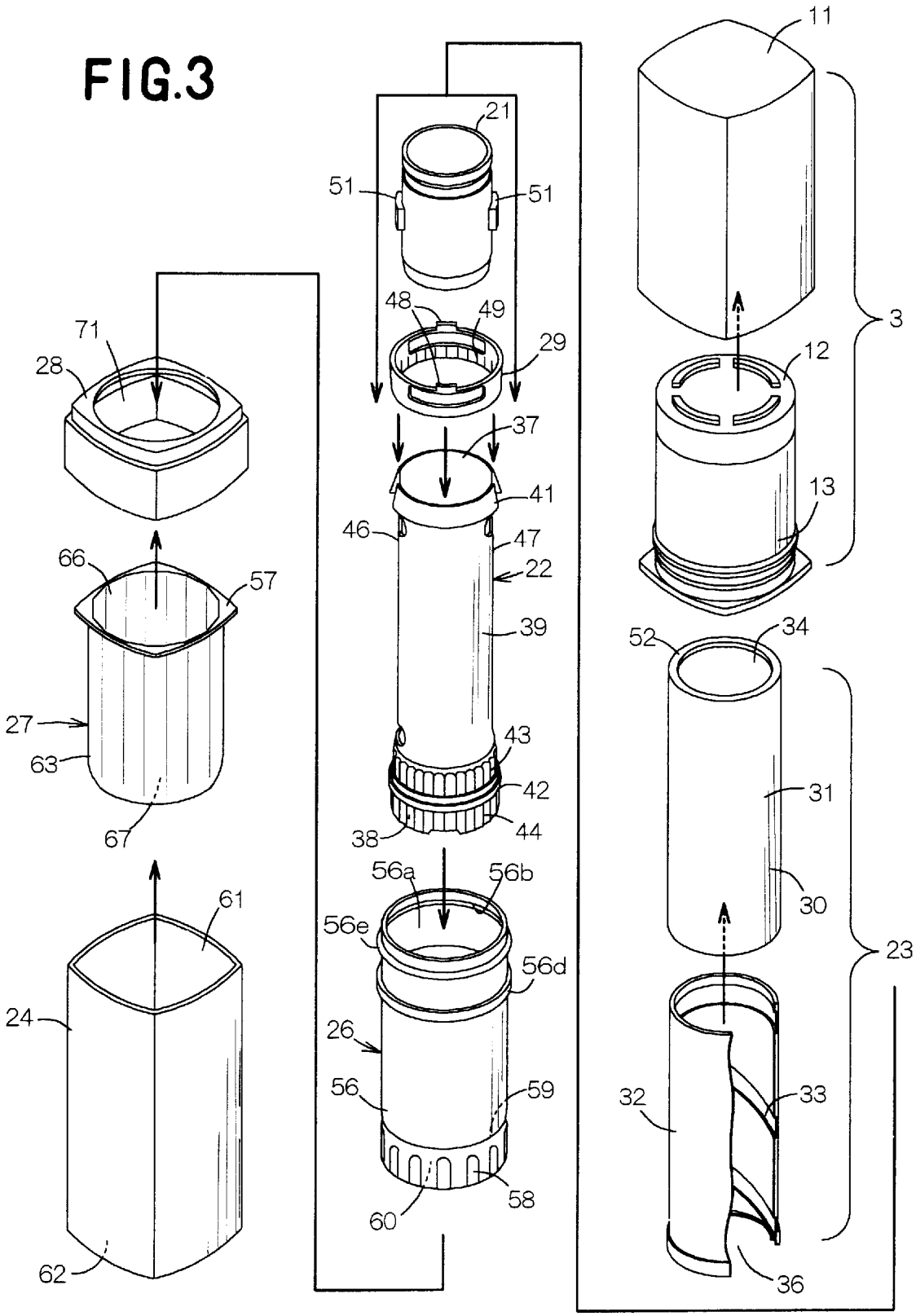
FIG. 3 is an exploded perspective view of the thrust-out type container.
Figure 4:
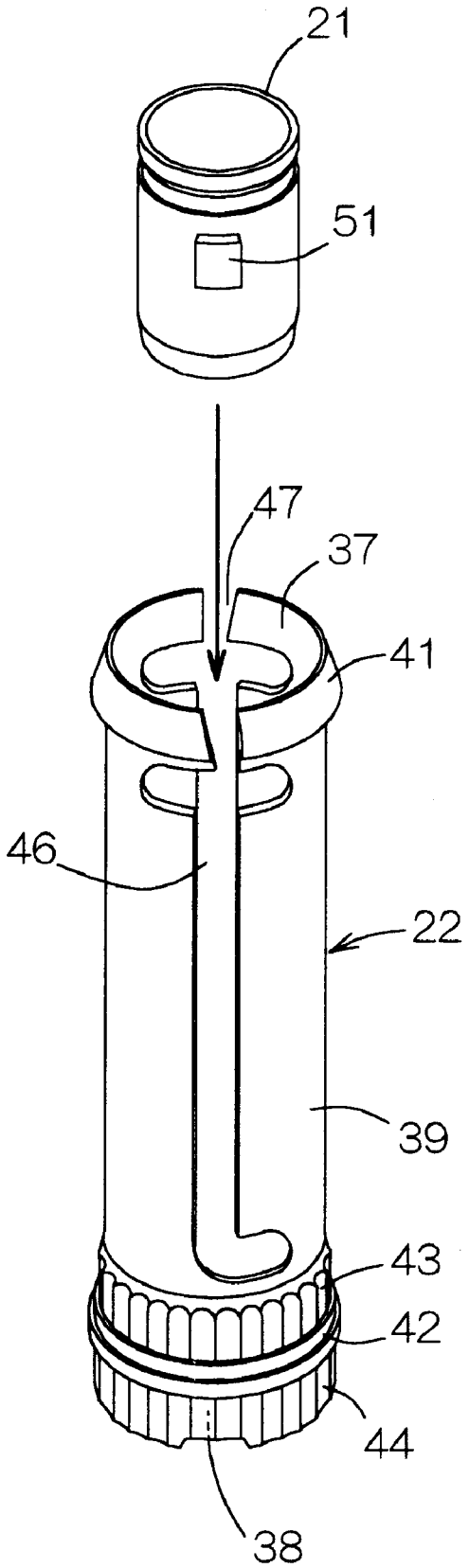
FIG. 4 is a side view showing a movable member and an inner cylinder.
Figure 5:
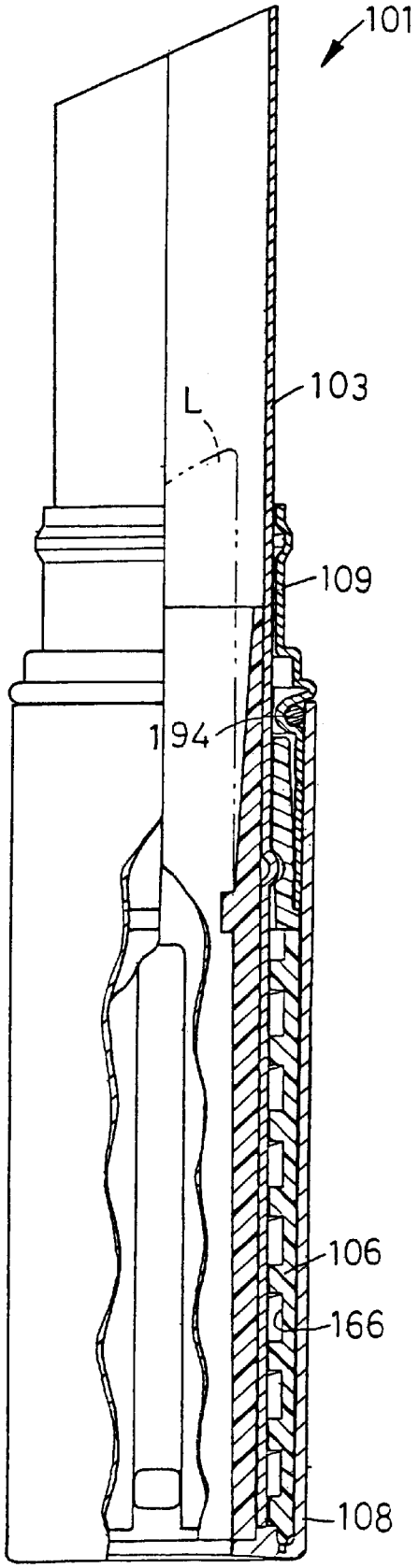
FIG. 5 is a partially cutaway side view showing an example of the conventional thrust-out type container.

FIG. 2 is a sectional view of the container taken along a line II—II in FIG. 1, FIG. 3 is an exploded perspective view of the container 1 and FIG. 4 is a side view of a movable member 21 and an inner cylindrical tube 22. In FIG. 2, the cap 3 is placed on the body 2 and illustration of the lipstick L is eliminated.

The cap 3 shown in FIG. 2 comprises an outer cap 11 and an inner cap 12 which is tightly inserted into the outer cap 11 from its bottom without any possibility that the inner cap 12 might fall off from the outer cap 11. A lower end portion 13 of the inner cap 12 is elastically deformable radially of the cap 3 and snap-engageable with a first intermediate cylindrical tube 26 of the body 2.

The body 2 shown in FIG. 2 has a central axis C and there are provided, around this central axis C and radially outward from the axis C, the movable member 21 carrying the lipstick thereon (not shown) and being movable in the vertical direction, the inner cylindrical tube 22 lying outside the movable member 21, the outer cylindrical tube 23 lying outside the inner cylindrical tube 22 and the control tube 24 lying outside the outer cylindrical tube 23 in this order. The first intermediate cylindrical tube 26 is interposed between the outer cylindrical tube 23 and the control tube 24, a second intermediate cylindrical tube 27 is interposed between the first intermediate cylindrical tube 26 and the control tube 24 and a cover member 28 is placed on a top of the control tube 24. An annular spring 29 normally biasing the outer cylindrical tube 23 upward is interposed between respective lower end portions of the inner cylindrical tube 22 and the outer cylindrical tube 23.

Referring to FIG. 3, arrows associated with the respective members indicate a sequence in which the body 2 is assembled. The assembling of the body 2 is carried out in a manner as will be described. The outer cylindrical tube 23 consists of a first outer cylindrical tube 31 and a second outer cylindrical tube 32 which is tightly inserted into the first outer cylindrical tube 31 from its bottom without any possibility that the second outer cylindrical tube 32 might fall off from the first outer cylindrical tube 31. The second outer cylindrical tube 32 is formed on its inner peripheral surface with a pair of spiral grooves 33 spaced from each other by 180° in a circumferential direction. The outer cylindrical tube 23 assembled in this manner has a top opening 34, a bottom opening 36 and a peripheral wall 30 extending between these openings 34, 36. The peripheral wall 30 is formed inside with the spiral grooves 33 (See FIG. 2 also).

The inner cylindrical tube 22 has a front face as shown in FIG. 3 and its left side face as viewed in FIG. 3 is shown in FIG. 4 with the movable member 21. The inner cylindrical tube 22 has a top opening 37, a bottom opening 38 and a peripheral wall 39 extending between these openings 37, 38. The top opening 37 is formed along its peripheral edge with an upper flange 41 and the bottom opening 38 is formed along its peripheral edge with a lower flange 42. The inner cylindrical tube 22 is further provided along its outer peripheral surface with a plurality of projections arranged intermittently in the circumferential direction so as to form upper anti-rotation means 43 and lower anti-rotation means 44 immediately above and below the lower flange 42, respectively. The peripheral wall 39 is partially cut out to form a pair of guide slits 46, 47 extending in the vertical direction and diametrically of the inner cylindrical tube 22 opposed to each other (See FIG. 4). The annular spring 29 is put around the top of the inner cylindrical tube 22. The annular spring 29 is provided on its inner peripheral surface with a plurality of projections arranged intermittently in the circumferential direction so as to form inner anti-rotation means 49. The inner anti-rotation means 49 engaged with the upper anti-rotation means 43 of the inner cylindrical tube 22 prevents the annular spring 29 from moving in the circumferential direction of the inner cylindrical tube 22. The annular spring 29 has a pair of sub-springs 48 which are elastically deformable in the vertical direction as viewed in FIG. 3. The cylindrical movable member 21 is received within the inner cylindrical tube 22.

The movable member 21 has a pair of arms 51 lying at a same level in the vertical direction of the member 21 and protruding radially outward from the outer peripheral surface of the member 21 in the opposite direction each other. With the movable member 21 received within the inner cylindrical tube 22, these two arms 51 extend outward through the associated guide slits 46, 47. The movable member 21 is movable within the inner cylindrical tube 22 in the vertical direction along the respective guide slits 46, 47. However, rotation of the movable member 21 around the center axis C is prevented by the arms 51 coming in contact with edges of the respective guide slits 46, 47 extending in the vertical direction. Therefore the movable member 21 is movable around the center axis C together with the inner cylindrical tube. From above, the outer cylindrical tube 23 is put around the inner cylindrical tube 22 having received therein the movable member 21. With the outer cylindrical tube 23, the peripheral edge of the bottom opening 36 comes in contact with the annular spring 29 from above and the flange 52 around the top opening 34 bears against the upper flange 41 of the inner cylindrical tube 22 from below being biased upward by the annular spring 29. The pair of arms 51 of the movable member 21 extending outward through the respective guide slits 46, 47 of the inner cylindrical tube 22 are received by the respective spiral grooves 33 of the outer cylindrical tube 23.

The inner cylindrical tube 22 around which the outer cylindrical tube 23 has been put has its lower part received within the first intermediate cylindrical tube 26. The first intermediate cylindrical tube 26 has a peripheral wall 56 and a top opening 56*a*. Below the opening 56*a*, the inner surface of the peripheral wall 56 is depressed so as to raise the outer surface thereof so that an annular groove 56*b* and an annular upper flange 56*e* may be formed on these inner and outer surfaces, respectively. Below the upper flange 56*e,* an annular lower flange 56*d* extends in parallel to the upper flange 56*e.* Lower end of the peripheral wall 56 is provided on its inner surface with a plurality of projections which are convex inward and arranged intermittently in the circumferential direction of the peripheral wall 56 so as to form anti-rotation means 58 and an undercut portion 59 immediately above the anti-rotation means 58 (See FIG. 2). Along the undercut portion 59, the outer surface of the peripheral wall 56 is annularly depressed inward.

With the inner cylindrical tube 22 received within the first intermediate cylindrical tube 26, the inner cylindrical tube 22 can no more move within the first intermediate cylindrical tube 26 not only in the vertical direction of the first intermediate cylindrical tube 26 but also in the circumferential direction thereof. This is for the reason that, as will be apparent from FIG. 2, a bottom of the inner cylindrical tube 22 comes in contact with a bottom 60 of the first intermediate cylindrical tube 26, the lower anti-rotation means 44 of the inner cylindrical tube 22 is engaged with the anti-rotation means 58 of the first intermediate cylindrical tube 26 and, in addition, the undercut portion 59 formed on the inner peripheral surface of the first intermediate cylindrical tube 26 overlies the lower flange 42 of the inner cylindrical tube 22. The bottom 60 of this first intermediate cylindrical tube 26 is closed. The top opening 56*a* of the first intermediate cylindrical tube 26 has its peripheral edge surrounding the outer cylindrical tube 23.

The square control tube 24 has an upper opening 61 and a lower closed bottom 62. The second intermediate cylindrical tube 27 has a peripheral wall 63, a polygonal top opening 66 and a closed bottom 67. With the second intermediate cylindrical tube 27 inserted from its bottom 67 into the control tube 24, a top flange 57 of the second intermediate cylindrical tube 27 comes in contact with the top of the control tube 24 and a peripheral edge of the polygonal top opening 66 is pressed against the inner peripheral surface of the control tube 24. Received within the control tube 24 in this manner, the second intermediate cylindrical tube 27 can no more move within the control tube 24 in the vertical direction as well as in the circumferential direction. The cover member 28 is put around the top of the control tube 24 having received therein the second intermediate cylindrical tube 27. The bottom 62 of the control tube 24 as well as the bottom 67 of the second intermediate cylindrical tube 27 may have openings, respectively, instead of being closed as in the illustrated embodiment. It is also possible for the peripheral wall 63 of the second intermediate cylindrical tube 27 to have diameter-reduced or circular cross-sectional lower part so that the lower part may be easily inserted into the control tube 24.

Into the control tube 24 with the cover member 28 put around the top of the tube 24, the first intermediate cylindrical tube 26 integral with the inner cylindrical tube 22 received within the outer cylindrical tube 23 is inserted with its bottom 60 ahead through an opening 71 of the cover member 28. The first intermediate cylindrical tube 26 has its peripheral wall 56 tightly put against the inner surface of the polygonal peripheral wall 63 of the second intermediate cylindrical tube 27 until the lower flange 56*d* of the first intermediate cylindrical tube 26 comes in contact with the top of the cover member 28. In this state, the first intermediate cylindrical tube 26 can no more move within the second intermediate cylindrical tube 27 not only in the vertical direction but also in the circumferential direction.

Into the body 2 adapted to be assembled in the manner as has been described above, the lipstick may be incorporated using the method of well known art before the body 2 is assembled or after the body 2 has been assembled. The inner peripheral surface of the elastically deformable lower part 13 of the inner cap 12 bears against the upper flange 56*e* of the first intermediate cylindrical tube 26 (See FIGS. 2 and 3) as the cap 3 is put on the body 2. Thereupon, the inner cap 12 and the first intermediate cylindrical tube 26 of the container 1 define a practically air-tight space so that low boiling point ingredients of the lipstick confined within this space may be prevented from easily evaporating. When it is desired to incorporate the lipstick in the body 2, the inner cylindrical tube 22 having the closed bottom 50 as illustrated in FIG. 2 may be replaced by the inner cylindrical tube 22 of which the bottom 50 has an opening.

When the lipstick is used, the cap 3 is taken off, with the thereby exposed outer cylindrical tube 23 held with fingers, the control tube 24 is rotated in the direction indicated by the arrow P in FIGS. 1 and 2. Rotation of the control tube 24 causes the second intermediate cylindrical tube 27 integral with this control tube 24 and the first intermediate cylindrical tube 26 integral with the second intermediate cylindrical tube 27 to rotate in the direction P around the outer cylindrical tube 23. Simultaneously, the inner cylindrical tube 22 integral with the first intermediate cylindrical tube 26 rotates together with the movable member 21 received within the inner cylindrical tube 22 within the outer cylindrical tube 23 in the direction P. The movable member 21 carrying the lipstick moves upward within the inner cylindrical tube 22 as the arms 51 of the movable member 21 move along the spiral grooves 33 of the outer cylindrical tube 23. In this way, the lipstick is thrust out through the respective openings 37, 34 of the inner cylindrical tube 22 and the outer cylindrical tube 23. In FIG. 2, the movable member 21 lying at a descendent position of the inner cylindrical tube 22 is indicated by solid lines and the movable member 21 lying at an ascendant position of the inner cylindrical tube 22 is indicated by imaginary lines.

While the body 2 and the cap 3 are shaped in square tubes in the embodiment illustrated, these members 2, 3 may be replaced by those shaped in cylindrical tubes. In this case, the second intermediate cylindrical tube 27 may be eliminated and the first intermediate cylindrical tube 26 may be force fitted to the inner side or the outer side of the control tube 24. It is also possible to eliminate the cover member 28. This invention comprises the first intermediate cylindrical tube 26 and the cap 3 which are tightly engaged with each other so as to form a sealed space in which the rod-like article is received. So far as such a container can be formed, the inner structure of the first intermediate cylindrical tube 26 is not limited to the illustrated embodiment and may be appropriately selected. It is possible to provide the movable member 21 with one or three or more arms 51 and the outer cylindrical tube 23 may be formed with one or three or more spiral grooves 33. The first intermediate cylindrical tube 26 as well as the second intermediate cylindrical tube 27 may be integrally injection molded of plastic so that the first intermediate cylindrical tube 26 may be provided with anti-rotation function for the control tube 24. It is also possible to mold the first intermediate cylindrical tube 26, the second intermediate cylindrical tube 27 and the cover member 28 integrally one with another.

The thrust-out type container for a rod-like article according to this invention has the advantageous effects the intermediate cylindrical tube cooperates with the cap to define the practically air-tight space within which the rod-like article is confined. With this container, evaporation of low boiling point ingredients in the rod-like article is restrained and thereby a storage stability of the rod-like article is improved.

What is claimed is:

1. A thrust-out type container for a rod-like article having a vertical direction and a radial direction orthogonal to said vertical direction and basically comprising a body adapted to thrust out the rod-like article through an opening formed at its upper end in said vertical direction and a cap adapted to be detachably put on said body from above in said vertical direction, said body comprising, around an axis extending in said vertical direction and radially outward from said axis, a movable member, an inner cylindrical tube, an outer cylindrical tube and a control tube in this order, said movable member being adapted to carry the rod-like article thereon and movable in said vertical direction, said inner cylindrical tube having an opening at its upper end in said vertical direction and lying outside said movable member to receive said movable member so that said movable member can move in said vertical direction and rotate together with said inner cylindrical tube around said axis, said outer cylindrical tube having an opening an its upper end in the vertical direction and lying outside said inner cylindrical tube to receive said inner cylindrical tube so that said inner cylindrical tube can rotate around said axis, said control tube lying outside said outer cylindrical tube and coupled to said inner cylindrical tube below said outer cylindrical tube so that said control tube can rotate around said axis together with said inner cylindrical tube, said body further comprising, between said outer cylindrical tube and said control tube, an intermediate cylindrical tube fixed to a peripheral surface of said control tube, surrounding said outer cylindrical tube and being rotatable around said outer cylindrical tube wherein an outer peripheral surface of said intermediate cylindrical tube and inner peripheral surface of said cap come in air-tight contact with each other, said thrust-out type container further comprising:

said intermediate cylindrical tube extends downward beyond respective lower ends of said inner and outer cylindrical tubes and has a closed bottom covering the respective lower ends of these inner and outer cylindrical tubes from below.

2. The thrust-out type container according to claim 1, wherein said movable member presents a circular or polygonal cross-section in said radial direction and includes at least one arm extending outward from an outer peripheral surface of said movable member in said radial direction of said movable member and wherein said inner cylindrical tube has a first upper end as viewed in said vertical direction, a first lower end as viewed in said vertical direction and a first peripheral wall extending between these two ends, said first peripheral wall being formed with at least one guide slit by making a long cut therein in said vertical direction so that said arm of said movable member lying inside said first peripheral wall extends outward and can be guided through said slit in said vertical direction.

3. The thrust-out type container according to claim 2, wherein said outer cylindrical tube has a second upper end as viewed in said vertical direction, a second lower end as viewed in said vertical direction and a second peripheral wall extending between these two ends, said second peripheral wall being formed on its inner surface with at least one spiral groove extending between these two ends so as to receive said arm of said movable member slidably along said spiral groove.

4. The thrust-out type container according to claim 1, wherein said intermediate cylindrical tube is coupled to said inner cylindrical tube below said outer cylindrical tube so that said intermediate cylindrical tube can rotate together with said inner cylindrical tube.

5. The thrust-out type container according to claim 1, wherein a second intermediate cylindrical tube presenting a polygonal cross-section in said radial direction is interposed between said control tube and said intermediate cylindrical tube.

6. The thrust-out type container according to claim 1, wherein said control tube presents a polygonal cross-section in said radial direction.

* * * * *